US006053009A

United States Patent [19]

Broggian

[11] Patent Number: 6,053,009

[45] Date of Patent: Apr. 25, 2000

[54] DEVICE FOR JOINING AND/OR SUPPORTING JEWELLER ARTICLES, SUCH AS PREVIOUS METALS AND PEARLS

[76] Inventor: Andrea Broggian, Piazza Ponti ang. Via Trombini. 2, 21013 Gallarate (Varese), Italy

[21] Appl. No.: 08/982,154

[22] Filed: Dec. 1, 1997

[30] Foreign Application Priority Data

May 6, 1997 [IT] Italy ..... MI970318 U

[51] Int. Cl.[7] ..... A44C 25/00

[52] U.S. Cl. ..... 63/38; 63/3.1; 63/4; 63/15; 63/26; 63/29.1; 59/80

[58] Field of Search ..... 63/3, 3.1, 4, 15, 63/23, 26, 29.1, 35, 38, 40; 59/80, 82, 84

[56] References Cited

U.S. PATENT DOCUMENTS

| | | | |
|---|---|---|---|
| 1,032,025 | 7/1912 | Robbins | 63/26 X |
| 1,728,266 | 9/1929 | Fassnacht | 63/26 |
| 3,115,758 | 12/1963 | Eberle et al. | 63/29.1 X |
| 3,820,201 | 6/1974 | Burckhardt | 63/38 |
| 5,343,718 | 9/1994 | Poll | 63/26 |

FOREIGN PATENT DOCUMENTS

| | | | |
|---|---|---|---|
| 2329224 | 5/1977 | France | 63/12 |
| 252410 | 12/1947 | Switzerland | 63/4 |

*Primary Examiner*—Terry Lee Melius
*Assistant Examiner*—Andrea Chop
*Attorney, Agent, or Firm*—Hedman, Gibson & Costigan, P.C.

[57] ABSTRACT

The present invention relates to a device for joining elements forming jeweller articles, such as precious metals and pearls, which device comprises: a pair of pin arranged at respective cross sections of a metal half-ring shaped link, made of a precious material; a pair of opposite holes arranged on the outer surface of a pearl so that the pair of pins can be housed in the holes to form a coupling element between the pearl and the metal ring-shaped link.

5 Claims, 2 Drawing Sheets

DEVICE FOR JOINING AND/OR SUPPORTING JEWELLER ARTICLES, SUCH AS PREVIOUS METALS AND PEARLS

BACKGROUND OF THE INVENTION

The present invention relates to a device for coupling elements forming jeweller articles or precious articles in general.

More specifically, the present invention relates to a device allowing to easily and quickly join element made of precious metals to elements comprising pearls.

Prior devices used for coupling the above mentioned precious elements usually comprise a housing in which are set pearls and possible precious stones.

These prior devices, however, greatly limit making and decorating possibilities in the jewellery field.

Moreover, the mentioned prior devices frequently use glueing substances for firmly holding the pearls in their housings, thereby, frequently, the glued pearls can detach and be lost.

SUMMARY OF THE INVENTION

The aim of the present invention is to solve the above mentioned problems, by providing a device which allows to firmly and quickly join elements forming jeweller articles.

This object is achieved by providing a pair of pins engaging in respective engaging holes formed on the surface of the pearl.

Thus, a joining device is provided which can be easily used for properly mounting a pearl in a desired firmly locked condition.

Moreover, the device according to the invention can be easily made on a large scale and at a comparatively low cost.

Accordingly, the invention specifically relates to a device for joining elements forming jeweller articles, such as precious metals and pearls, characterized in that said device comprises: a pair of pins arranged at respective cross sections of a metal half-ring shaped link, made of a precious material; a pair of opposite holes formed on an outer surface of a pearl, allowing said pair of pins to be engaged in said pair of holes thereby providing a joining element between said pearl and said metal half-ring shaped link.

According to the present invention, each pin comprises, in turn: a base element, provided with a spring, and engaged in a respective hole formed in the cross-section of said half-ring shaped link; a projecting element, coated by an adhesive substance and engaged in a hole formed on the surface of the pearl.

According to a further aspect of the invention, the metal half-ring shaped link is arranged at one end of a metal chain construction.

BRIEF DESCRIPTION OF THE DRAWINGS

The present invention will be disclosed hereinafter, by way of an illustrative, but not limitative example, in preferred embodiments thereof, with reference to the figures of the accompanying drawings, where.

DESCRIPTION OF THE PREFERRED EMBODIMENTS

Two preferred embodiments of the invention will be disclosed hereinafter by way of a merely indicative example.

Figure 1:
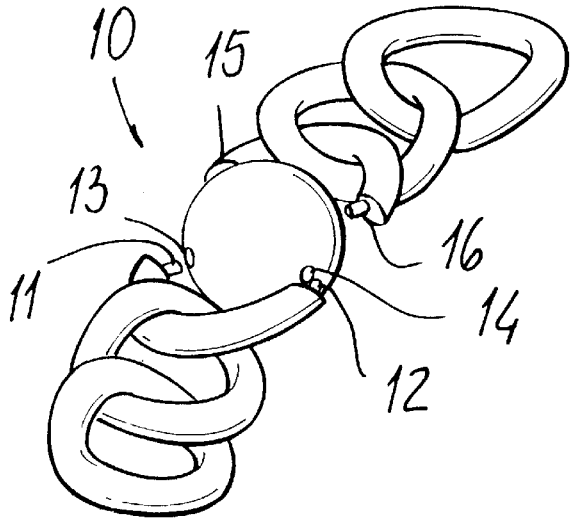
FIG. 1 is a perspective view of a jeweller article, including a metal chain, and provided with a first embodiment of the joining device according to the present invention.
Figure 2:
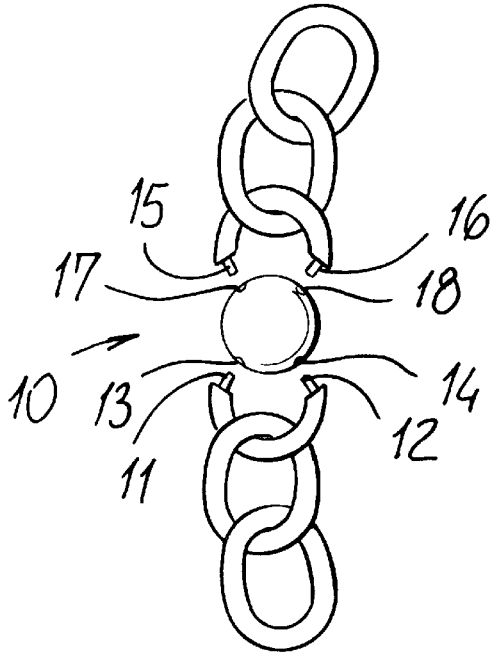
FIG. 2 is a top plan view of the jeweller article shown in FIG. 1.
Figure 3:
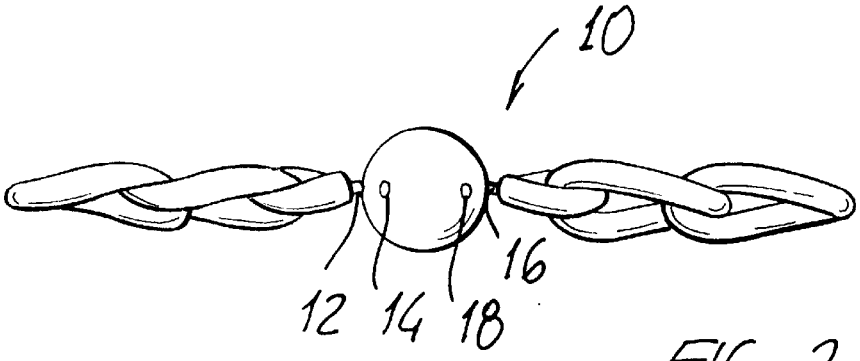
FIG. 3 is a side view of the jeweller article shown in FIGS. 1 and 2.

With reference to FIGS. 1 and 3, the joining device 10, according to a first embodiment of the invention, comprises: a first pair of pins 11, 12; a first pair of opposite holes 13 and 14; a second pair of pins 15 and 16 and a second pair of opposite holes 17 and 18.

The device 10 has been applied to a jeweller article comprising a metal chain construction made of a precious material.

At one end of the mentioned metal chain is arranged a metal split or half-ring shaped link, at the cross-sections of which are provided pin elements.

As shown the pin elements, which are substantially rectilinear, converge in pairs to one another thereby each pair of converging pins defines a substantially acute angle therebetween.

On the outer surface of the pearl are provided opposite holes, specifically designed for engaging therein said pins.

In particular, the pearl is mounted by spreading apart the end portions of the link, which link will automatically re-close owing to the resiliency of the metal material thereof.

Figure 4:
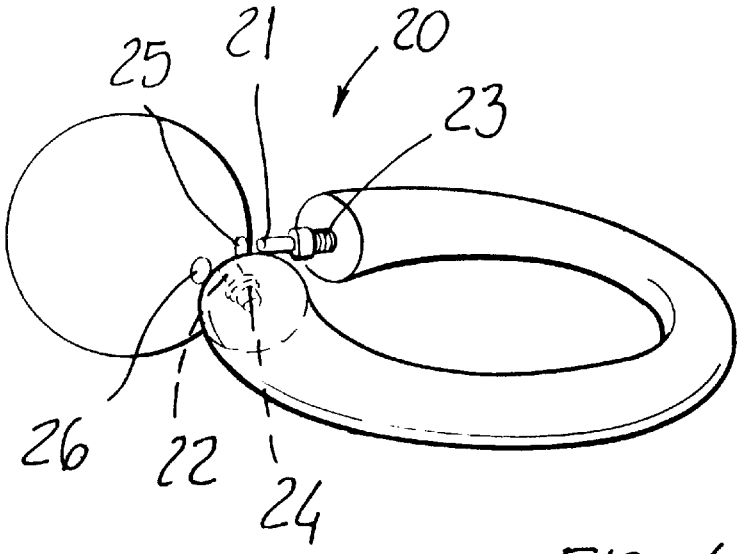
FIG. 4 is a perspective view of a metal link ring element, constituting a second embodiment of the device according to the invention.
Figure 6:
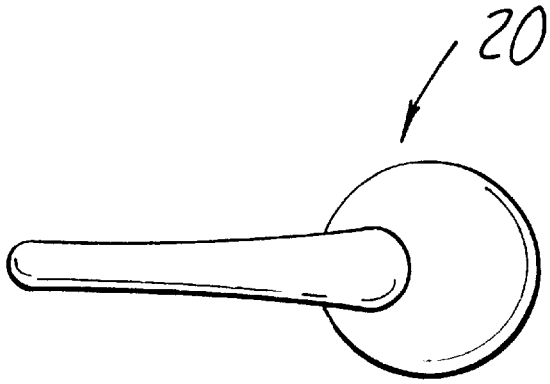
FIG. 6 is a side view of the ring element shown in FIGS. 4 and 5.

FIGS. 4 and 6 show a second embodiment of the joining device 20, as applied to a ring including a split-ring body, provided for forming, as coupled to a pearl, a ring-shaped jeweller ring article.

This device comprises two pins 21 and 22, each of which is provided with a cylindrical bottom enlarged portion abutting against a respective helical spring 23 and 24, each coupled to an end flat portion of the split ring body.

These springs are provided for facilitating the insertion of said pins 21 and 22 into said holes 25 and 26 formed on the surface of the pearl.

Figure 5:
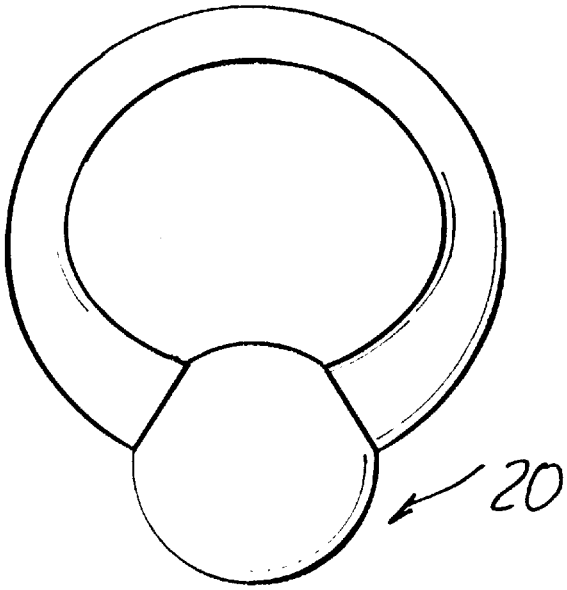
FIG. 5 is a top plan view of the ring element of FIG. 4.

FIGS. 5 and 6 specifically show the perfect coupling of the pearl to the body of the ring provided by the subject device 20.

The procedure for mounting the pearl in its housing, according to the invention, is very simple and provides the following operating steps:

a) spreading apart the end portions of the metal element;

b) engaging the pins in their respective holes formed on the surface of the pearl;

c) releasing the end portions of the metal element, so as to lock the pearl in its related housing.

In order to provide a better coupling, it is provided, according to the present invention, to apply on the surface of the mentioned pins a suitable adhesive substance.

Thus, it should be apparent that the invention fully achieves the intended aim and objects, since the invention provides a device allowing to easily and firmly join elements forming jeweller articles.

In this connection it should be apparent that the inventive device can be also used for different elements, both in the jeweller field and in the gift article field.

While the invention has been disclosed and illustrated with reference to preferred embodiments thereof, it should be apparent that the disclosed embodiments are susceptible to many modifications and variations, all of which will come within the scope of the appended claims.

I claim:

1. A jewelry assembly comprising a resilient precious metal split ring element defining two substantially flat end surfaces each having a pair of substantially rectilinear converging end pins, each of said pins including a helical spring, said helical springs each projecting from a said flat end surface of said split ring element, and a pearl having a surface with at least a pair of opposite holes formed therein, said pins being adapted to be resiliently spread apart for engaging each in a respective said hole of said pearl thereby providing, upon releasing of a spreading-apart force thereon, a firm joining between said pearl and said resilient precious metal split ring element thereby providing a substantially closed ring-like shape.

2. A jewelry assembly according to claim 1, wherein each said pin comprises an enlarged base there against abuts a respective spring.

3. A jewelry assembly according to claim 1, wherein said resilient precious metal split ring element comprises an end link of a metal chain.

4. A jewelry assembly according to claim 1, wherein said resilient precious metal split ring element constitutes, together with said pearl, a finger ring.

5. A jewelry assembly which consists essentially of a resilient precious metal split ring element defining two substantially flat end surfaces each having a pair of substantially rectilinear converging end pins, each of said pins including a helical spring, said helical springs each projecting from a said flat end surface of said split ring element, and a pearl having a surface with at least a pair of opposite holes formed therein, said pins being adapted to be resiliently spread apart for engaging each in a respective said hole of said pearl thereby providing, upon releasing of a spreading-apart force thereon, a firm joining between said pearl and said resilient precious metal split ring element thereby providing a substantially closed ring-like shape.

* * * * *